US005794465A

United States Patent [19]

Hill

[11] Patent Number: 5,794,465

[45] Date of Patent: Aug. 18, 1998

[54] KEY LOCK BOX ASSEMBLY

[75] Inventor: Matthew S. Hill, Salem, Oreg.

[73] Assignee: Supra Products, Inc., Salem, Oreg.

[21] Appl. No.: 561,921

[22] Filed: Nov. 22, 1995

[51] Int. Cl.[6] ..... E05B 65/48; E05B 67/00

[52] U.S. Cl. ..... 70/63; 248/552; 70/232; 70/DIG. 57; 70/51

[58] Field of Search ..... 70/63, 54, 55, 70/56, 51, 52, 53, DIG. 57, 232; 248/551, 552

[56] References Cited

U.S. PATENT DOCUMENTS

| | | | |
|---|---|---|---|
| 1,688,187 | 10/1928 | Jackson et al. | 70/51 |
| 2,930,219 | 3/1960 | Fansmith | 70/51 |
| 3,392,555 | 7/1968 | Beaver | 70/56 |
| 3,559,429 | 2/1971 | Hermann | 70/56 |
| 3,721,112 | 3/1973 | Wellekens | 70/52 |
| 3,783,657 | 1/1974 | Foote | 70/52 |
| 4,353,521 | 10/1982 | Webb | 248/551 |
| 4,718,261 | 1/1988 | Kunz | 70/276 |
| 5,046,339 | 9/1991 | Krell | 70/55 |
| 5,152,160 | 10/1992 | Lentini | 70/54 |
| 5,179,848 | 1/1993 | Kief | 70/54 |
| 5,280,518 | 1/1994 | Danler et al. . | |
| 5,456,443 | 10/1995 | Taaffe | 70/DIG. 57 |
| 5,590,608 | 1/1997 | Yore et al. | 248/552 |

FOREIGN PATENT DOCUMENTS

| | | | |
|---|---|---|---|
| 877027 | 8/1971 | Canada | 70/54 |
| 2610276 | 8/1988 | France | 70/227 |
| 628178 | 4/1936 | United Kingdom | 70/51 |

*Primary Examiner*—Darnell M. Boucher
*Attorney, Agent, or Firm*—Klarquist Sparkman Campbell Leigh & Whinson, LLP

[57] ABSTRACT

The present invention concerns an assembly for removably securing a real estate key box to a fixed structure, such as a door or wall. The assembly is designed so that when the key box is mounted on the assembly and locked, neither the key box nor the assembly can be removed from the structure.

13 Claims, 2 Drawing Sheets

KEY LOCK BOX ASSEMBLY

TECHNICAL FIELD

This invention relates to an assembly for removably securing a key lock box to a wall or other fixed structure.

BACKGROUND OF THE INVENTION

Real estate professionals often show a property many times before finding a buyer or lessee. To avoid the inconvenience of having to carry keys to the property each time, they have a long-established practice of leaving the keys on-site in a secure place. Most often, keys are placed in a key box which is hung from the door knob. Typically, a key box has an internal compartment for containing one or more keys and a shackle with a locking mechanism for securing the key box to the doorknob. In addition, many modern key boxes include sophisticated electronic data processing features.

While prior key boxes have allowed realtors to store keys on-site, they all possess the common limitation that they are intended to be hung only from a doorknob. This leaves them in plain view and, therefore, exposed to would-be burglars. Further, the keybox shackle may scratch the doorknob or mar the door when the key box is mounted and removed.

SUMMARY OF THE INVENTION

The key box assembly of the present invention is designed to solve these and other problems associated with prior key boxes. Accordingly, it is an object of the present invention to provide an assembly suitable for securing a key box to structures other than a door knob, such as a wall, a door or other fixed structure.

It is a further object of the present invention to provide a key box assembly which prevents unauthorized removal of the key box from the fixed structure.

These and other objects of the present invention will become readily apparent from the following invention summary and detailed description, which proceeds with reference to the accompanying drawings.

The present invention provides an assembly for removably securing a key box to a fixed structure, such as a wall. The key box includes an internal compartment for storing a key, and a latch or shackle which may be locked to secure the key box. The key box may also have sophisticated electronic data entry, storage and transmission features, as well as other electronic and physical features.

The key box assembly consists of a bracket, a fastener for removably attaching the bracket to a wall or other structure and a cap piece. After the bracket is attached to a structure by the fastener, the cap piece is mounted onto the bracket. When mounted, the cap piece blocks access to the fastener, preventing removal of the fastener and the bracket. The cap piece also has means, such as a curved channel, for receiving the key box shackle. When the shackle is seated in the cap piece channel and locked, neither the key box nor the assembly can be removed from the fixed structure until the shackle is unlocked.

DETAILED DESCRIPTION OF AN ILLUSTRATED EMBODIMENT

Figure 1:
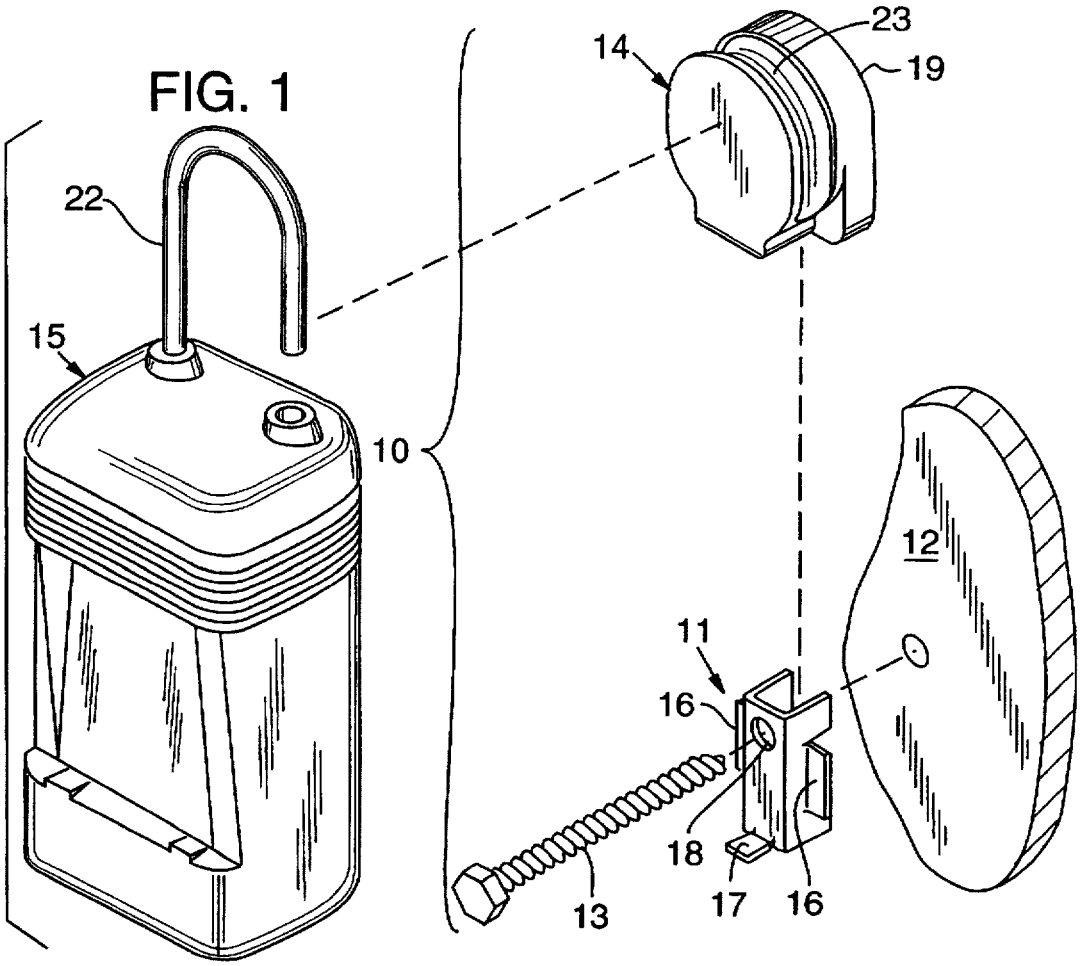
FIG. 1 is an exploded perspective view of a cap piece, bracket and fastener in accordance with a preferred embodiment of the present invention.
Figure 2:
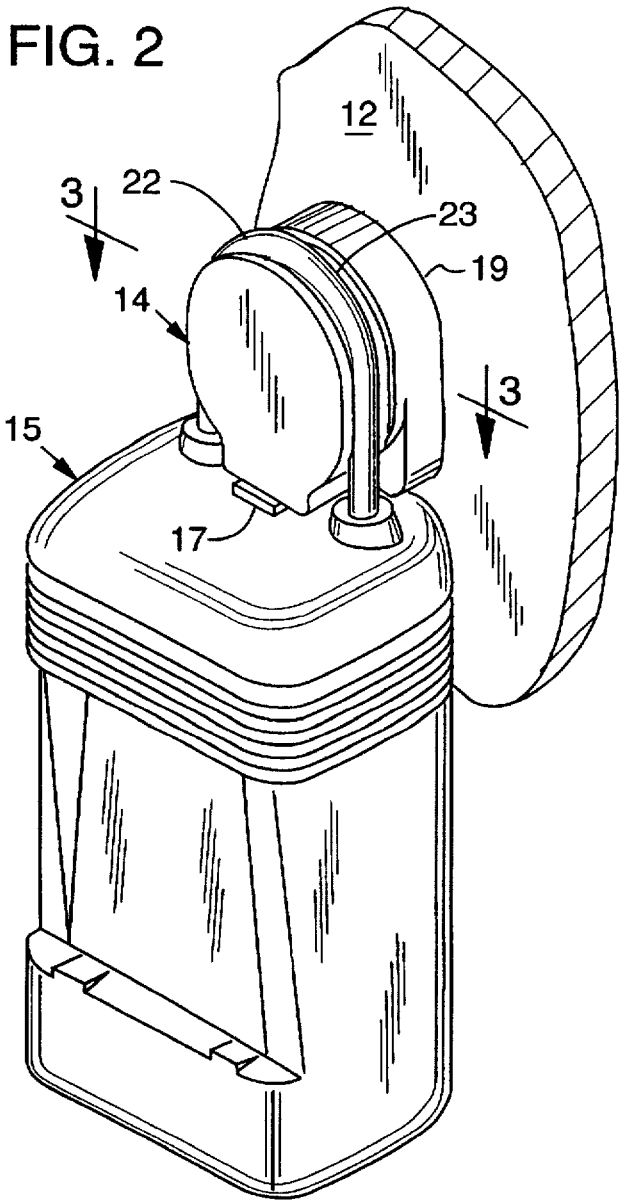
FIG. 2 is a perspective view depicting the key box assembly of FIG. 1 with key box secured thereto.

A key box assembly in accordance with a preferred embodiment of the present invention is illustrated in FIG. 1 as reference numeral 10. Referring to FIG. 1, the key box assembly 10 includes a bracket 11 that can be removably fixed to a wall 12, or some similar structure, by a screw 13. A cap piece 14 slidingly engages the bracket 11 so as to cover the screw 13 and prevent its removal. As shown in FIG. 2, a locking key box 15 may be affixed to the cap piece 14 in a manner that prevents removal of the cap piece from the bracket, thereby preventing access to the screw 13. In this manner, the illustrated key box assembly prevents the unauthorized removal of the key box.

Figure 3:
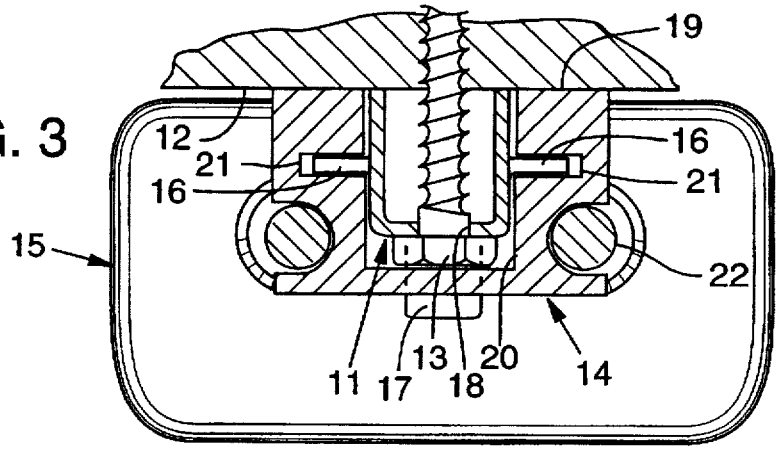
FIG. 3 is a cross-sectional top view taken along line 3—3 in FIG. 2.

Referring to FIG. 3, the illustrated bracket 11 is generally U-shaped when viewed from the top. Wings 16 extend from each side of the bracket, and a bottom tab 17 extends from the base. The bracket is provided with an aperture 18 for receiving a fastener, such as a screw 13, to fix the bracket to a wall 12 or other fixed structure. Although the illustrated fastener is a screw, any fastener which operates to attach the bracket to a fixed structure is suitable for the assembly of the invention. In the illustrated embodiment, the bracket is formed of a single piece of sheet metal. Of course, other materials could also be used.

Figure 4:
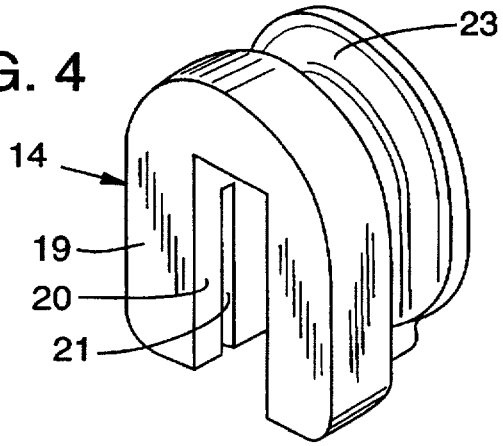
FIG. 4 is a perspective rear view of the cap piece of FIG. 2.

As shown in FIG. 4, the cap piece 14 has a generally flat rear surface 19 having a recess 20 formed therein. The recess 20 is open at the bottom and is shaped so as to allow sliding engagement with the bracket 11. In particular, the recess is provided with two wing-receiving channels 21 to receive the wings 16 formed in the bracket, as shown in FIG. 3. In this manner, once the cap piece is slid onto the bracket, it can only be removed by sliding it in the reverse direction. In the illustrated embodiment, the bottom tab 17 engages the cap piece when the cap is slid onto the bracket into the installed position. In the installed position, illustrated in FIG. 2, the rear surface 19 generally abuts the wall 12.

The recess in the cap piece is shaped to receive and enclose the top of the screw 13. In particular, when the cap piece is in the installed position, the cap piece covers the top of the screw to prevent removal of the screw. In the illustrated embodiment, the cap piece is formed of metal, such as aluminum; however, those skilled in the art will recognize that other materials may be used.

The perimeter of the cap piece is shaped to conform generally to a shackle 22 on the key box 15. In the illustrated embodiment, a channel 23 is provided for receiving and engaging the shackle 22 to allow the key box to be mounted to the cap piece with the key box held suspended below the cap piece. In other suitable embodiments, the key box may have an attachment member other than a shackle and the cap piece may have means other than a channel for engaging the attachment member.

When mounted to the cap piece, the top of the key box abuts the bottom tab 17 of the bracket to prevent upward movement of the cap piece. In this manner, the cap piece can be securely locked in its installed position (with the top of the screw covered) by the key box. As a result, when the key box assembly is installed with key box shackle 22 seated in channel 23 and locked, neither the key box nor the assembly can be removed until the shackle is unlocked.

A key box with a lockable shackle suitable for the present invention is depicted in FIG. 2. The illustrated shackle 22 is curved to conform to cap piece channel 23. Without limiting the present invention, a locking mechanism suitable for the key box of the present invention is disclosed in U.S. Pat. No. 5,280,518 to Danler, et al.

The key box assembly of the illustrated embodiment may be quickly and easily installed. Bracket 11 is positioned on the wall or fixed structure in the desired location. Screw 13 is inserted through bracket aperture 18 and tightened. The cap piece 14 is positioned over the bracket with wing-receiving channels 21 positioned above bracket wings 16. The cap piece is mounted onto the bracket by sliding the cap piece down onto the bracket until its base meets bottom tab 17. Key box shackle 22 is then latched over cap piece channel 23 and locked. So locked, the key box prevents removal of the cap piece which covers the screw, rendering the key box and key box assembly unremovable.

Having described and illustrated the principles of our invention with reference to an illustrated embodiment, it should be apparent that the invention can be modified in arrangement and detail without departing from its principles. Accordingly, we claim all modifications as may come within the scope and spirit of the following claims.

I claim:

1. A key box assembly for removably securing a key box to a fixed structure, the key box having a lockable, U-shaped shackle the assembly comprising:

a bracket, the bracket defining an aperture which receives a fastener;

said fastener for removably attaching the bracket to the fixed structure;

a cap piece, the cap piece comprising a recessed area shaped to slidably engage the bracket and to enclose portions of the fastener to prevent removal of the fastener when the cap piece is engaging the bracket, the cap piece further defining an elongated curved channel means for conforming to the inner U-shaped surface of the shackle, said channel means adapted to be surrounded by the shackle to attach the key box to the cap piece, the cap piece configured so that the key box is adapted to abut the bracket when the shackle is in an attached locked position to prevent removal of the cap piece.

2. The assembly of claim 1 wherein the recessed area of the cap piece includes two wing-receiving channels for receiving the bracket wings.

3. The assembly of claim 1 wherein the cap piece further comprises a flat base portion for engaging the top surface of the bottom tab when the cap piece is engaged on the bracket.

4. A key box assembly for removably securing a key box to fixed structure, the key box having a lockable, U-shaped shackle, the assembly comprising:

a fastener;

a bracket, the bracket defining an aperture, wherein the fastener is inserted through the aperture to removably attach the bracket to the fixed structure;

a cap piece, having an elongated curved channel means for conforming to the inner curved surface of the shackle and a flat rear surface having a recess formed therein for slidably engaging the bracket, said elongated curved channel means lying in a plane perpendicular to said fastener; said cap piece is adapted to fit within the curved surface of the shackle to attach the key box to the cap piece whereby the key box cannot be removed from the fixed structure while the shackle of the key box is attached and locked to the cap piece.

5. The assembly of claim 4 wherein the recess formed in the rear surface of the cap piece includes two wing-receiving channels for receiving the bracket wings.

6. The assembly of claim 4 wherein the cap piece further comprises a flat base for engaging a top surface of the bottom tab when the cap piece is engaged on the bracket.

7. The assembly of claim 6 wherein a top portion of the key box is adapted to abut a bottom side of the bottom tab when the key box is engaged with the cap piece, thereby preventing removal of the cap piece.

8. A key box assembly for removably securing a key box to a fixed structure, the key box having a lockable, U-shaped shackle, the assembly comprising:

a fastener;

a bracket, wherein the bracket defines an aperture, wherein the fastener is inserted through the aperture for removably attaching the bracket to the fixed structure;

a cap piece having a U-shaped curved channel means for engaging with and conforming to the inner curved surface of the shackle, a flat rear surface having a recess formed therein which slidably engages the bracket; the recess having two wing-receiving channels which receive the bracket, and a flat base engaging a top surface of the bracket when the cap piece is engaged on the bracket;

wherein a top portion of the key box is adapted to abut a bottom surface of the bracket when the key box is engaged in the curved channel means thereby preventing removal of the cap piece from the bracket and removal of the assembly from the fixed structure.

9. The assembly of claim 8 wherein the cap piece blocks access to a exposed portion of the fastener when the cap piece is engaged on the bracket.

10. A key box assembly for removably securing a key box to fixed structure, the key box having a lockable, U-shaped shackle, the assembly comprising:

a fastener;

a bracket, wherein the bracket defines an aperture, wherein the fastener is inserted through the aperture to removably attach the bracket to the fixed structure;

a cap piece, having an elongated curved channel means for conforming to the inner curved surface of the shackle to attach the key box to the cap piece; said cap piece including a flat rear surface having a recess formed therein which slidably engages the bracket; said elongated curved channel means and said shackle adapted to lie in the same plane when the key box is attached to said cap piece whereby the key box cannot be removed from the fixed structure while the shackle of the key box is attached and locked to the cap piece.

11. The assembly of claim 10 in combination with a key box having a lockable U-shaped shackle and an internal compartment for storing one or more keys, said key box being attached to the cap piece.

12. The assembly of claim 1 in combination with a key box having a lockable shackle and an internal compartment for storing one or more keys, the shackle being characterized by first and second shapes, the first shape being a circular cross-section thereof, the second shape being a U-configuration, said key box being attached to the cap piece.

13. The assembly of claim 4 in combination with a key box having a U-shaped shackle and an internal compartment for storing one or more keys, the key box being attached to the cap piece.

* * * * *